US006472360B1

(12) United States Patent
Beggs et al.

(10) Patent No.: US 6,472,360 B1
(45) Date of Patent: Oct. 29, 2002

(54) MULTIPLE COMPONENT HARD SURFACE CLEANING COMPOSITIONS

(75) Inventors: David Victor Beggs; Alexander Martin; Nicola Rogers; David William Thornthwaite; Joan Lesley Williams; Fraser William Whyte, all of Bebington (GB)

(73) Assignee: Unilever Home & Personal Care USA division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/548,087

(22) Filed: Apr. 12, 2000

(30) Foreign Application Priority Data

Apr. 12, 1999 (GB) ..... 99302822

(51) Int. Cl.[7] ..... C11D 17/04; C11D 3/39
(52) U.S. Cl. ..... 510/372; 510/375; 510/376
(58) Field of Search ..... 510/376, 375, 510/370, 372, 406

(56) References Cited

U.S. PATENT DOCUMENTS

| | | | |
|---|---|---|---|
| 3,760,986 | A | 9/1973 | Castner et al. |
| 5,954,230 | A | 9/1999 | Kubicek et al. |

FOREIGN PATENT DOCUMENTS

| | | | |
|---|---|---|---|
| EP | 0 744 465 | A | 11/1996 |
| JP | 60/038497 | | 2/1985 |
| WO | 95/16023 | A | 6/1995 |
| WO | 97/31087 | A | 8/1997 |
| WO | 98/23533 | A | 6/1998 |
| WO | 99/32598 | A | 7/1999 |

OTHER PUBLICATIONS

European Search Report dated Sep. 13, 1999.
International Search Report dated Jul. 4, 2000.

*Primary Examiner*—Yogendra N. Gupta
*Assistant Examiner*—John M Petruncio
(74) *Attorney, Agent, or Firm*—Ronald A. Koatz

(57) ABSTRACT

The invention provides liquid hard surface cleaning compositions comprising multiple partial compositions held separately from each other in a multiple compartment container which is provided with a non-spray dispensing system. One partial composition comprises a peroxygen bleach compound, preferaqbly hydrogen peroxide. The total composition comprises a multi-component thickening system of which the components are divided over the partial compositions in such a way that the total composition thickens on dispensing. Each partial composition has a pH at which the components in it are stable, while after mixting the total composition has a pH suitable for cleaning.

The compositions preferably contain a quaternary imine salt bleach activator and a detergent surfactant.

The number of partial compositions and of the compartments in the container is preferably 2.

17 Claims, No Drawings

MULTIPLE COMPONENT HARD SURFACE CLEANING COMPOSITIONS

FIELD OF THE INVENTION

The invention relates to liquid cleaning compositions consisting of at least two partial compositions which are stored separate from each other in a single container comprising at least two chambers, and which are mixed on use, one partial composition comprising a peroxygen bleach compound.

The compositions are intended for cleaning and disinfecting household surfaces and are particularly well adapted for use on surfaces which are non-horizontal (i.e. sloping or vertical) as can be found e.g. in bathrooms and toilets.

BACKGROUND OF THE INVENTION

Compositions which clean and disinfect for use on non-horizontal surfaces presently comprise solutions of alkali metal hypochlorite to be poured, squirted or sprayed onto the surface. Such solutions are thickened so as to prevent them from draining off the surface too quickly. Particularly for toilet cleaning purposes they are often marketed packed in containers provided with a spout such that they may be delivered to the surface by squeezing the container. Sometimes such spouts are mounted on the container in such a way that the squirt of liquid produced by the squeezing action may be more easily directed to corners or under rims which cannot easily be reached otherwise.

One problem with said compositions is that hypochlorite has an unpleasant odour and, when accidentally mixed with an acidic product, it can liberate toxic amounts of chlorine gas. Other bleaching agents are known, particularly peroxides. However, peroxides are often either unstable on storage in formulations or exhibit poor bleaching performance at a pH at which they are storage stable.

Toothpastes and peroxide-based hair bleaching compositions have been formulated as weakly acidic peroxide solutions or gels, which are mixed with separate weakly alkaline solutions or pastes just before use. The known advantage of this form of product is that under acidic conditions the peroxide is more stable to decomposition, but is more effective as a bleaching agent under alkaline conditions.

Other two-part peroxide based compositions are disclosed in JP-A-60/038497 (LION BRANDS), which relates to a foaming, two-part drain cleaning composition which comprises:

a) 0.5–50%wt hydrogen peroxide, b) alkali, having an alkalinity 0.1–50% based on sodium hydroxide, c) surface active agent in (a) or (b), and, d) terpene alcohol/cyclic terpene alcohol in (a) or (b).

The compositions (a) and (b), including the surfactants and terpene are sequentially or simultaneously dosed into a toilet bowl and pass into the drains where the composition produces a body of foam which acts to clean or if necessary unblock the drain.

Other forms of simultaneous delivery of two components are known. Thus, U.S. Pat. No. 3,760,986 discloses a dispensing bottle for dispensing two separate fluids to a common point. Such a bottle is formed with an opening at the top and a divider extending through the interior of the bottle to define two compartments which provide dual reservoirs for fluids. The apparatus disclosed further comprises a pump means to simultaneously withdraw fluid from each compartment, via separate draw tubes, and discharge the fluid to a common point. This device enables an alkaline and an acid material to be stored separately and sprayed from a single unit to a common point.

WO 95/16023 discloses a container comprising two chambers or reservoirs, one containing a liquid acid or neutral composition comprising a peroxide compound and the other containing a liquid alkaline composition. The container is provided with a spray system able to either produce a single spray of a mixture of the two components or two simultaneous sprays of each component directed to the same point on a surface whereafter the components mix on the surface. The product is delivered as fine droplets which coalesce on the surface which provides for easy and complete mixing of the two compositions. It is described that the compositions may be thickened as is or they may contain a thickener system which thickens on mixing. The thickening system is particularly geared to improve the spraying characteristics and prevent respiratory irritation caused by very fine droplets. The examples show both components to be thickened before spraying.

WO 97/31087 discloses a container comprising two chambers or reservoirs, one containing a liquid composition comprising a peroxygen bleach and the other containing a liquid composition comprising a builder or chelating agent and at least one of these liquids containing a pH adjusting agent which on mixing of the liquids brings the pH of the mixture to a value at which the peroxygen bleach is effectively cleaning as well as stable. Preferably the peroxygen bleach is either a peracid or a persalt and the pH is between 9.0 and 11.5. The two liquid compositions are mixed on delivery to the surface, preferably by a spray system. A similar system is described in WO 98/23533 in which a combination of hydrogen peroxide and a tertiary N-alkyl ammonium acetonitrile salt from one chamber and an alkaline solution from another chamber may be deliverd to a surface by spraying.

These prior art two component peroxide cleaning systems have the disadvantage that a spray system is only able to deliver a limited amount of product to a surface and is unable to reach difficultly accessible places since the container generally must be held vertically. Therefore they are less suitable for toilet cleaning purposes. Moreover, spray systems such as trigger spray heads and pump sprays are relatively expensive, particularly those which are suitable for multicompartment containers.

BRIEF DESCRIPTION OF THE INVENTION

It is therefore an object of the present invention to provide liquid hard surface cleaning compositions which comprise a peroxygen bleach, are stable on storage and yet give good cleaning and disinfection on application to a surface.

It is another object of the invention to provide liquid hard surface cleaning compositions which can be easily applied to a surface using a non-spray dispensing system and are sufficiently thick on the surface to be suitable for cleaning non-horizontal surfaces, particularly toilets.

It is a further object of the invention to provide liquid hard surface cleaning compositions in which components which are not storage stable in each others presence are held separate from each other until the time of dispensing of the composition on the surface.

Accordingly, the invention provides liquid cleaning compositions consisting of at least two liquid partial compositions which are held separate from each other in a single container comprising at least two chambers or reservoirs or compartments (hereinafter referred to as 'chambers') and a non-spray dispensing system, at least one partial composition comprising a peroxygen bleach compound which cleaning composition comprises a multi-component thickening system of which the components are divided over at least two partial compositions, such that on mixing of the partial compositions on delivery to the surface to be cleaned the combination of the components of the thickening system causes the final composition to thicken and cling to non-horizontal surfaces. Each partial composition has a pH such that the components of that partial composition are stable on storage, while after admixture of the partial compositions the final composition has a pH suitable for cleaning.

Furthermore the invention provides thickened liquid cleaning-compositions obtained through mixing of two or more partial compositions on delivery through a non-spray dispensing system, at least one partial composition comprising a peroxygen bleach compound and at least two partial compositions each comprising one or more (but not all) components of a multi-component thickening system, such that thickening is obtained by the mixing of the partial compositions, each partial composition having a pH such that the components of that partial composition are stable on storage, while after admixture of the partial compositions the final composition has a pH suitable for effective cleaning.

Also, the invention provides a container comprising two or more chambers each provided with an outlet opening for dispensing the content of each chamber which together form part of a non-spray dispensing system, said container holding the liquid partial compositions described above.

DETAILED DESCRIPTION OF THE INVENTION

For the purposes of this invention a 'partial composition' is defined as a component, or a mixture of more, but not all, components of the final composition, which component or mixture is held in a separate chamber of the container containing the total composition. Two or more partial compositions together make up the final cleaning composition according to the invention.

A container suitable for holding the cleaning compositions according to the invention has at least as many separate chambers as the number of partial compositions making up the total composition. Such container may have one outer wall embracing all chambers which are separated from each other by partion walls inside the container or, alternatively, it may be made up of a plurality of separate containers, equivalent to the chambers, which are held together by some external means, such as a connecting part of the walls or an adhesive sleeve surrounding them, in such a way that they can be held and handled as one container. A dispensing system is provided in that each chamber is provided with an outlet opening through which the partial composition is dispensed. These outlet openings may all lead to a separate mixing chamber in which the dispensed amounts of the partial compositions mix just before being applied to the surface through a dispensing opening in the mixing chamber. Alternatively, the outlet openings may all lead to the outside of the container in such a way that the dispensed amounts of the partial compositions are all applied simultaneously to the same area of the surface so as to mix while being applied to the surface or immediately after application on the surface. To this end the outlet openings will generally be positioned in close proximity to each other such that all partial compositions are poured, squirted onto the same area of the surface in one operation. The outlet openings may be provided with a nozzle system designed to further improve the mixing of the partial components on leaving the container. Dispensing systems such as described above and similar ones known in the art are comprised in the term 'non-spray dispensing systems'. They are generally characterised by the absence of so called 'trigger spray heads or pump spray heads' and, unlike such spray heads, operate without the application of external pressure over and above ambient pressure or by pressure exerted by the operation of decreasing the total content of the container, such as by squeezing the flexible walls of a container as is well known for dispensing liquid hypochlorite toilet cleaners, hand dishwash liquids and similar liquid products.

For practical reasons, such as ease of construction and handling the container preferably comprises no more than two chambers each holding a partial composition which compositions together make up the final cleaning composition according to the invention. This implies that for the same reasons the cleaning compositions according to the invention are preferably made up of two partial compositions. Additionally the container may comprise a mixing chamber as outlined above.

The amounts of the partial compositions making up the final composition need not necessarily all be equal as long as care is taken that the concentration of each component in each of the partial compositions is chosen such that on mixing of the envisaged amounts of the partial compositions the right concentration of each component is present in the final composition. The volume of each chamber of the container is adapted to the amount of the partial composition contained in that chamber which is required to make up the total amount of the final composition in the container. The total liquid volume of the final composition to be obtained from the container in general will be about equal to the total volume of the container, excluding the volume of the mixing chamber, if present.

The dispensing system, e.g. the dispensing or outlet openings of the chambers of the container, is dimensioned such that one single dispensing operation dispenses the right amounts of all partial compositions necessary to properly make up the final composition in which each component is present in the desired concentration.

Although there is no theoretical limitation as to the size and shape of the containers, for practical purposes, such as ease of handling and dispensing, the containers will generally have a total volume of 0.1–2 liters, preferably at least 0.25 1, but preferably not more than 1.5 1. Also for practical purposes two-chamber containers preferably have chambers of about equal volume, holding about equal amounts of each of the two partial compositions.

Suitable containers have been described in the co-pending British patent applications no.: 98 15659.9, 98 15660.7 and 98 15661.5.

The peroxygen bleach compound may be any peroxide or peroxide generating system known in the art. Well known examples are: hydrogen peroxide, various organic or inorganic peracids e.g. perbenzoic acid and substituted perbenzoic acids, various aliphatic peroxy acids and diperoxy acids such as peracetic acid, diperoxy-dodecanedioic acid, N,N-phthaloylamino-peroxycaproic acid (PAP), various organic or inorganic persalts such as monoperoxosulphates, perborates, perphosphates, persilicates, etc. Such peroxygen bleach compounds may be used in combination with bleach activator compounds to enhance their bleaching activity. Many do require activator compounds to obtain proper bleaching action.

Preferred peroxygen bleach compounds are hydrogen peroxide, peracetic acid and alkali metal or alkaline earth metal monoperoxosulphate salts. Hydrogen peroxide is particularly suitable. The amount of peroxygen compound is preferably chosen such that the final composition will contain 0.05–10% active oxygen, more preferably 0.1–5%, most preferably at least 0.5%.

The partial composition containing the peroxygen compound has a pH at which the peroxygen compound is storage stable. Many peracids and persalts have limited stability in alkaline solutions and therefore a partial composition containing these will preferably have a pH of at most 8, more preferably at most 7.5, most preferably 7 or below. Hydrogen peroxide is reasonably stable up to pH 10, although for longer term stability the pH should preferably not exceed 9.5, more preferably be at most 9.0, most preferably be at most 8.0

Many bleach activators are to be found among the acylated (particularly acetylated) amines and amides of which tetracetyl-ethylenediamine (TAED) is probably the most well known example. Very well known examples of peroxide/activator combinations are perborate/TAED and percarbonate/TAED.

Useful bleach activator compounds are the cationic nitrites, such as: the N-alkyl-ammonium acetonitriles, described in EP-A-0 303 520, EP-A-0 458 396, EP-A-0 464 880, WO 96/40661, WO 98/23533, DE 196 29 159 and EP-A-0 790 244 and the cyanopyridinium and pyridine-N-oxide compounds disclosed in EP-A-0 806 473 and EP-A-0 819 673. Similarly useful cyano activator compounds are disclosed in EP-A-0 819 673 and DE 196 09 955.

Particularly useful bleach activator compounds are imines such as the sulfonimines described in U.S. Pat. No. 5,041,232, U.S. Pat. No. and U.S. Pat. No. 5,047,163, and quaternary imine salts (imine quats). The imine quats are generally described and many specific examples given in U.S. Pat. No. 5,360,568, U.S. Pat. No. 5,360,569 and U.S. Pat. No. 5,478,357. Further examples thereof are described in WO 96/34937, WO 97/10323, WO 98/16614 and U.S. Pat. No. 5,710,116.

Suitable sulfonimines have the general structure below:

$$R^1R^2C{=}N{-}SO_2{-}R^3$$

wherein:

$R^1$ may be hydrogen or a substituted or unsubstituted phenyl, aryl, heterocyclic, alkyl or cycloalkyl group;

$R^2$ may be hydrogen or a substituted or unsubstituted phenyl, aryl, heterocyclic, alkyl or cycloalkyl group or a keto, carboxylic, carboalkoxy or $R^1C{=}N{-}SO_2{-}R^3$ group;

$R^3$ may be a substituted or unsubstituted phenyl, aryl, heterocyclic, alkyl or cycloalkyl group or a nitro, halo or cyano group;

$R^1$ with $R^2$ and/or $R^2$ with $R^3$ may respectively form a cycloalkyl, heterocyclic or aroilatic ring system.

Suitable imine quaternary salts have the general structure below:

$$R^1R^2C{=}N^+R^3R^4X^-$$

wherein:

$R^1$ and $R^4$ may be hydrogen or substituted or unsubstituted phenyl, aryl, heterocyclic, alkyl or cycloalkyl groups;

$R^2$ may be hydrogen or a substituted or unsubstituted phenyl, aryl, heterocyclic, alkyl or cycloalkyl group or a keto, carboxylic or carboalkoxy group;

$R^3$ may be a substituted or unsubstituted phenyl, aryl, heterocyclic, alkyl or cycloalkyl group or a nitro, halo or cyano group;

$R^1$ with $R^2$ and/or $R^2$ with $R^3$ may respectively form a cycloalkyl, heterocyclic or aromatic ring system.

$X^-$ is a counterion which is stable in the presence of peroxide compounds.

Preferred imine quaternary salts (imine quats) are those having the 3,4-dihydro-isoquinolinium structure below:

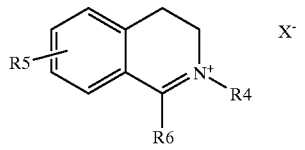

in which R5 and R6 may be hydrogen or a C1–C30 substituted or unsubstituted phenyl, aryl, heterocyclic ring, alkyl, cycloalkyl radical or a nitro, halo, cyano, alkoxy, carboxylic and carboalkoxy radical, and R4 may be a C1–C30 unsubstituted or substituted phenyl, aryl, heterocyclic ring, alkyl and cycloalkyl radical. R5 may represent more than one substituent in the aromatic ring. Representative examples of compounds according to the general structure (having one R5) are given in the table below.

| Comp. | R4 | R5 | R6 | $X^-$ |
|---|---|---|---|---|
| 1 | $CH_3$ | H | H | $BF_4$— |
| 2 | $CH_3$ | H | H | p-tosylate |
| 3 | $CH_3$ | $CH_3$ | H | $Cl^-$ |
| 4 | $CH_3$ | $NO_2$ | H | $Br^-$ |
| 5 | $CH_3$ | Cl | H | $BF_4^-$ |
| 6 | $CH_3$ | $OCH_3$ | H | brosylate$^-$ |
| 7 | phenyl | H | H | $CH_3SO_4^-$ |
| 8 | benzyl | phenyl | H | $Cl^-$ |
| 9 | $(CH_2)_2OH$ | CN | H | $PF_6^-$ |
| 10 | $CH_3$ | $CH_2COCH_3$ | H | $PF_6^-$ |
| 11 | $(CH_3)_2CH$ | $COCH_3$ | H | $CH_3CH_2SO_4^-$ |
| 12 | $CH_3$ | $SO_3^-Na^+$ | H | $Cl^-$ |
| 13 | $CH_3(CH_2)_{11}$ | H | H | p-tosylate$^-$ |
| 14 | $CH_3(CH_2)_{15}$ | Br | H | $CH_3SO_4^-$ |
| 15 | $CH_2CH_2N(CH_2)_3$ | H | H | $Cl^-$ |
| 16 | $CH_3$ | F | H | $Cl^-$ |
| 17 | $CH_3$ | $CF_3$ | H | $PF_6^-$ |
| 18 | $CH_3$ | $CH_2OPO_3Na_2$ | H | $Cl^-$ |
| 19 | $CH_3$ | $CH_2N^+(CH_3)_3$ | H | $CH_3SO_4^-$ |
| 20 | $CH_3CH_2O(CH_2)_2$ | H | H | $CH_3SO_4^-$ |
| 21 | $CH_3$ | $(CH_2)_7CH_3$ | H | $Cl^-$ |
| 22 | $CH_3$ | $CO_2^-Na^+$ | H | $Cl^-$ |
| 23 | $CH_3$ | H | phenyl | $Cl^-$ |
| 24 | $(CH_2)_7CH_3$ | H | H | p-tosylate$^-$ |
| 25 | $CH_3$ | H | $CH_3$ | $Cl^-$ |

Particularly useful are imine quats wherein R4 is an alkyl group, such as methyl, or substituted alkyl group and wherein R6 is hydrogen or a C1–C5 alkyl or a phenyl group. Also very useful are those compounds wherein R5 represents one or two methoxy groups, such as two methoxy groups in the 6 and 7 position. Examples of preferred imine quats are N-methyl-3,4-dihydroisoquinolinium salts and the corresponding quats in which R6 are methyl or ethyl respectively. These are particularly advantageous when used in combination with hydrogen peroxide.

Imine quats have only limited storage stability at high pH and therefore the partial composition containing these imines should preferably have pH below 8, more preferably at most 7, most preferably between 2.0 and 6.5. If used, the imine quat is generally present in an amount of 0.001–10%, preferably 0.01–5%, most preferably not more than 2% The molar ratio of peroxygen compound to imine quat will generally range from 1500:1 to 1:2, preferably from 150:1 to 1:1, more preferably from 60:1 to 2:1.

If a bleach activator compound is used, it may be a component of the same partial composition as the peroxygen compound, provided that the two have sufficient storage stability together at a pH which is suitable for the partial composition, taking into account the pH requirements of the final composition. Otherwise the activator and peroxygen compound are held separately in different partial compositions. Thus, partial compositions containing hydrogen peroxide and an imine quat together preferably have a maximum pH of 6.5, more preferably at most 6.

In order to obtain thorough mixing of the partial compositions on dispensing the partial compositions should all be thin before mixing i.e. have a viscosity of 20 mPa·s or below, preferably 10 mPa·s or below, more preferably at most 5 mPa·s (Haake™ R20 Viscometer, 25° C., shear rate: $21sec^{-1}$). Although the viscosities of all partial compositions before mixing do not necessarily have to be equal, they are preferably not far apart as this may influence the relative amounts of the partial compositions dispensed in one dispensing operation, and the mixing thereof. A difference in viscosity may be compensated by adjusting the dispensing means, e.g. by a correspondingly different dimensioning of the dispensing openings of the corresponding chambers.

During or immediately after application to the surface the cleaning composition thickens to the extend sufficient for it to cling to the surface and prevent it from draining off a non-horizontal surface before proper cleaning is obtained. This thickening is brought about through the mixing of the components of said multicomponent thickening system, the components of which are divided over at least two partial compositions. Preferably the viscosity of the final composition after dispensing is at least 50 mPa·s, more preferably at least 100 mPa·s On the other hand the viscosity is preferably not more than 1000 mPa·s. (measuring conditions: see above).

A large number of multicomponent thickening systems is known in the art. For them to be suitable for the cleaning compositions according to the invention, preferably at least one component should be storage stable in the same partial composition as the peroxygen bleach compound. The total thickening system should be sufficiently stable in the final composition to enable the composition to thicken and remain on the surface for long enough to perform its cleaning action.

Many thickening systems have been used in thickened hypochlorite bleach compositions. Such systems often consist of two or more different detergent surfactants, or of one or more such surfactants in combination with an electrolyte such as an inorganic salt. Many thickening systems comprise as one of their components a tertiary amine oxide, an ethoxylated fatty alcohol or other nonionic surfactant and as another components an anionic surfactant.

Examples of such thickening systems are described in EP-A-079697, EP-A-110544, EP-A-137551, EP-A-145084, EP-A-244611, EP-A-635568, W095/08611, DE-A-19621048 and the literature cited in these patent applications.

Other suitable thickening systems comprise polymeric substances which in solution thicken in response to an increase in pH or electrolyte concentration. Examples thereof are polymers of acrylic acid known for their thickening properties such as those sold under the trademark "Acusol".

Examples of various thickening systems, preferred ranges of the relative amounts of their components (in % of the total surfactant mix) and their possible split over partial compositions are given below:

| One partial composition | Other partial composition |
|---|---|
| Nonionic surfactant (60–30)<br>Cationic surfactant (40–70) | Inorganic salt |
| Cationic surfactant (10–30) | Anionic surfactant (90–70)<br>Inorganic salt |
| Anionic surfactant (90–70) | Cationic surfactant (10–30)<br>Inorganic salt |
| Amine oxide surfactant (85–60) | Anionic surfactant (15–40) |
| Nonionic surfactant (60–30)<br>Anionic surfactant (40–70) | Inorganic salt |
| Anionic surfactant (90–70)<br>Cationic surfactant (10–30) | Inorganic salt. |
| Cationic surfactant (95–85) | Anionic surfactant (5–15)<br>Inorganic salt |
| Polyacrylate latex | Alkaline pH adjusting agent |

For some multicomponent thickening systems components may all be present in one partial composition, if at least one of the components is present therein in a concentration below the concentration necessary to cause thickening of the system and the remainder of that component is present in another partial composition. Then, upon mixing of the partial compositions the concentration of that component in the final composition is increased to the level required to cause thickening.

Detergent surfactants often play an important role in thickening systems as outlined above. Independent thereof they are preferably added also for their wetting properties on hard surfaces and for their cleaning properties. Thus, preferably surfactants are present even if a non-surfactant-based thickening system is used. If not required for thickening, the total surfactants content is preferably between 0.1 and 20%, more preferably between 0.5 and 10%, most preferably at most 7%. If part of the thickening system the minimum total amount of surfactant will be at least 0.5%, preferably at least 1%.

Surfactants may be chosen from a wide range of anionic, nonionic, cationic, amphoteric or zwitterionic surfactants well known in the art.

Suitable anionic surfactants are e.g. water-soluble salts, particularly alkali metal, alkaline earth metal and ammonium salts, of organic sulphate esters and sulphonic acids having in the molecular structure a C8–C22 alkyl radical or a C10–C22 alkaryl radical. Examples of such anionic surfactants are alcohol sulphate salts, especially those obtained from the fatty alcohols derived from the glycerides of tallow or coconut oil; alkyl-benzene sulphonates such as those having a C9–C15 Examples of such anionic detergents are alcohol sulphate alkyl group attached to the benzene ring; secondary alkanesuiphonates; sodium alkyl glyceryl ether sulphates, especially those ethers of the fatty alcohols derived from tallow and coconut oil; sodium fatty acid monoglyceride sulphates, especially those derived from coconut fatty acids; salts of 1–6 EO ethoxylated fatty alcohol sulphates; salts of 1–8 EO ethoxylated alkylphenol sulphates in which the alkyl radicals contain 4–14 C-atoms; the reaction product of fatty acids esterified with isethionic acid and neutralised with sodium hydroxide.

The preferred water-soluble synthetic anionic surfactants are the alkyl benzene sulphonates, the olefin sulphonates, the alkyl sulphates, and the higher fatty acid monoglyceride sulphates. On the other hand fatty acids soaps are not very suitable for use in the cleaning compositions according to the invention.

A special class of anionic surfactants which may be used in the cleaning compositions according to the invention are hydrotropes which are known in the art specifically for their thickening or liquid structuring capabilities. Well known examples of such compounds are the alkali metal salts of toluene-, xylene- and cumene-sulphonic acid.

Suitable nonionic surfactants can be broadly described as compounds produced by the condensation of alkylene oxide groups, which are hydrophilic in nature, with an organic hydrophobic compound which may be aliphatic or alkylaromatic in nature. The length of the hydrophilic or polyoxyalkylene radical which is attached to any particular hydrophobic group can be readily adjusted to yield a water-soluble or water dispersible compound having the desired balance between hydrophilic and hydrophobic elements.

Particular examples include the condensation product of straight chain or branched chain aliphatic alcohols having 8–22 C-atoms with ethylene oxide, such as coconut oil fatty alcohol/ethylene oxide condensates having from 2 to 15 moles of ethylene oxide per mole of coconut alcohol; condensates of alkylphenols whose alkyl group contains 6–16 C-atoms with 2 to 25 moles of ethylene oxide per mole of alkylphenol; condensates of the reaction product of ethylenediamine and propylene oxide with ethylene oxide, the condensates containing from 40 to 80% of ethyleneoxy groups by weight and having a molecular weight of from 5,000 to 11,000. Other examples are: tertiary amine oxides of general structure RRRN0, where one R is a C8–C22 alkyl group (preferably C8–C18) and the other Rs are each C1–C5 (preferably C1–C3) alkyl or hydroxyalkyl groups, far instance dimethyldodecylamine oxide; tertiary phosphine oxides of structure RRRP0, where one R is a C8–C22 alkyl group (preferably C8–C18) and the other Rs are each C1–C5 (preferably C1–C3) alkyl or hydroxyalkyl groups, for instance dimethyl-dodecylphosphine oxide; dialkyl sulphoxides of structure RRS0 where one R is a C10–C18 alkyl group and the other is methyl or ethyl, for instance methyltetradecyl sulphoxide; fatty acid alkylolamides; alkylene oxide condensates of fatty acid alkylolamides and alkyl mercaptans. Ethoxylated aliphatic alcohols are particularly preferred. Amine oxides are also very suitable because they blend very well with inorganic electrolytes. Suitable amphoteric surfactants are derivatives of aliphatic secondary and tertiary amines containing a C8–C18 alkyl group and an aliphatic group substituted by an anionic water-solubilising group, for instance sodium 3-dodecylamino-propionate, sodium 3-dodecylaminopropane sulphonate and sodium N-2-hydroxydodecyl-N-methyl taurate.

Suitable cationic surfactants are quaternary ammonium salts having at least one C8–C22 hydrocarbon group, e.g. dodecyl-trimethylammonium bromide or chloride, cetyltrimethyl-ammonium bromide or chloride, didecyl-dimethyl-ammonium bromide or chloride. Many quaternary ammonium salts have antimicrobial properties and their use in cleaning compositions according to the invention leads to products having disinfection properties. They are used in the cleaning compositions according to the invention in an amount of 0–10%, preferably 0.1–8%, more preferably 0.5–6%

Suitable zwitterionic surfactants are derivatives of aliphatic quaternary ammonium, sulphonium and phosphonium compounds having a C8–C18 aliphatic group and an aliphatic group substituted by an anionic water-solubilising group, for instance 3-(N,N-dimethyl-N-hexadecylammonium)propane-1-sulphonate betaine, 3-(dodecyl-methyl-sulphonium)-propane-1-sulphonate betaine and 3-(cetylmethyl-phosphonium)-ethane-sulphonate betaine.

Further examples of suitable surfactants are given in the well-known textbooks "*Surface Active Agents* ", Volume I by Schwartz and Perry and "*Surface Active Agents and Detergents* ", Volume II by Schwartz, Perry and Berch.

Surfactants which are storage stable in combination with the peroxygen compound may be combined with the peroxygen compound in the same partial composition. Surfactants which do not have such stability should be made part of the other partial composition or compositions. Thus, quaternary ammonium halogenides are preferably not combined with the peroxygen compound in the same partial composition because of possible decomposition of the peroxygen compound by the halogenide ion. This holds in particular for bromides and iodides.

The partial composition containing the peroxygen bleach compound preferably also contains a sequestering agent to bind metal ions, particularly transition metal ions, which could otherwise destabilise the peroxygen compound. Suitable sequestering agents are e.g. etbylenediamine tetraacetate, amino-polyphosphonates (such as those in the DEQUEST™ range). A wide variety of poly-hydric organic and inorganic acids and salts, can also optionally be employed. Preferred sequestering agents are selected from dipicolinic acid, ethylenediamine tetra acetic acid (EDTA) and its salts, hydroxyethylidene diphosphonic acid (Dequest 2010), ethylenediamine tetra(methylene-phosphonic acid) (Dequest 2040), diethylene-triamine penta(methylene-phosphonic acid) (Dequest 2060). Such sequestering agents are generally used in an amount of 0.01–5%, preferably 0.05–2%.

Electrolytes, particularly inorganic salts, are part of many thickening systems. Suitable salts are alkali metal carbonates, sulphates and halogenides. Halogenides, especially bromides and iodides, are preferably kept separate from peroxygen compounds i.e. in different partial compositions. Electrolytes are used in an amount of 0–20%, preferably 0–15%, more preferably 0–10%.

Apart from sequestering agents particularly suitable for binding transition metal ions, as mentioned above, the cleaning compositions according to the invention may also usefully contain a sequestering agent suitable for binding Ca ions. Such sequestering agent may be contained in any of the partial compositions. Suitable sequestering agents for this purpose are well known in the art and include compounds such as: alkali metal tripolyphosphate, pyrophosphate and ortho- phosphate, sodium nitrilotriacetic acid salt, sodium methylglycine-diacetic acid salt, alkali metal citrate, carboxymethyl malonate, methylglycine diacetic acid, carboxymethyloxysuccinate, tartrate, mono- and di-succinate and oxydisuccinate.

As many peroxygen compounds are storage stable at a lower pH than that at which they develop their maximum bleaching effect, a partial composition not containing the peroxygen compound preferably contains sufficient alkali to raise the pH of the final composition from the level required for storage stability to that required for effective bleaching. Preferably the pH of the final composition should be 9.0 or above, more preferably at least 9.5, even more preferably at least 10.5, most preferably at least 11.0. Particularly suitable alkaline materials are alkali metal hydroxides and carbonates.

The final cleaning compositions are aqueous liquids and the partial compositions are preferably also all aqueous liquids although some or all may additionally contain organic solvent. Such organic solvents must be sufficiently stable with peroxygen bleach in order not to interfere with the cleaning process in the final composition. Also, not all thickening systems will thicken sufficiently in the presence of an organic solvent and therefore suitable thickening systems will have to be selected. For most cleaning purposes the presence of an organic solvent will not be required.

Other minor components may be present in the cleaning compositions according to the invention to improve their cleaning or disinfection properties, such as antimicrobially active compounds other than thesquaternary ammonium salts already mentioned above, or improve their consumer appeal. Examples of the latter are perfumes and dyes. Some perfume components, such as certain essential oils, are known in the art to have antimicrobial properties as well and so may provide a double activity.

For the purposes of the present invention a component or a partial composition will be considered to be storage stable if it still has at least 50% of its initial activity or activities after 10 days storage at 20° C. Depending on the components in the partial composition such activities may comprise: surfactant activity, thickening activity, disinfecting activity, active oxygen content, bleach activator activity, etc. For preferred storage stability the activity or activities should be at least 50% after 30 days storage, more preferably after 60 days storage at 20° C.

All percentages expressed herein are percentages by weight on the final composition unless indicated otherwise.

EXAMPLES I–XI

The following aqueous cleaning compositions were prepared each consisting of equal amounts of the partial compositions a) and b). The compositions all contain N-methyl-3,4-dihydroisoquinolinium tosylate as the imine quat. They were all stored in a dual chamber container consisting of two separate 'half containers' held together by an adhesive sleeve surrounding them and by the dispensing nozzle system made of one piece. Percentages in the examples are given by weight of the partial composition to which they pertain, the remainder being demin water. Thus, percentages in the final composition are half these values.

Ia (pH 5.5, viscosity<5 mPa·s)
4.0% Hydrogen peroxide (bleach)
0.4% Dequest 2060S*(sequestrant)
0.5% Imine quat (bleach activator)
10.0% Sodium sulphate (electrolyte/thickener component)
Ib (pH>11, viscosity<5 mPa·s)
2.0% Imbentin 91-35*(C10-5EO nonionic/thickener component)
1.0% Dobanol 1-3*(C10–3EO nonionic/thickener component)
4.0% Cetyl-trimethylammonium bromide (CTAB, cationic/thickener component)
2,6% Sodium hydroxide (alkali)

Final composition: pH>11, viscosity>50 mPa·s.

IIa (pH 5.6, viscosity<5 mPa·s)
4.0% Hydrogen peroxide (bleach)
0.4% Dequest 2060S (sequestrant)
0.5% Imine quat (bleach activator)
3.2% Dobanol 1-3*(nonionic/thickener component)
3.2% Imbentin 91-35*(C10–5EO nonionic/thickener component
8.7% Cetyl-trimethylammonium bisulphate (cationic/thickener component)
IIb (pH>11, viscosity<5 mPa·s)
5.50% Sodium chloride (electrolyte/thickener)
2.6% Sodium hydroxide (alkali)

Final composition: pH>11, viscosity>50 mPa·s.

IIIa (pH 5.5, viscosity<5 mPa·s)
4.0% Hydrogen peroxide (bleach)
0.4% Dequest 2060S (sequestrant)
0.5% Imine quat (bleach activator)
6.5% Cetyl-trimethylarmmonium bisulphate (cationic/thickener component)
IIIb (pH>11, viscosity<5 mPa·s)
0.26% Sec. alkyl sulphonate (SAS 30*, anionic/thickener component)
2.60% Sodium hydroxide (alkali)
0.80% Sodium chloride (electrolyte/thickener component)

Final composition: pH>11

IVa (pH 5.2, viscosity<5mPa·s)
4.0% Hydrogen peroxide (bleach)
0.4% Dequest 2060S (sequestrant)
0.5% Imine quat (bleach activator)
12.8% Sodium sulphate (electrolyte/thickener component)
IVb (pH>11, viscosity<5mPa·s)
3.00% CTAB (cationic/thickener component)
0.26% SAS 30 (anionic/thickener component)
2.30% Sodium hydroxide (alkali)

Final composition: pH 11.2, viscosity 395 mPa·s

Va (pH 5.2, viscosity<5mPa·s)
4.0% Hydrogen peroxide (bleach)
0.4% Dequest 2060S (sequestrant)
0.5% Imine quat (bleach activator)
4.9% Sodium chloride (electrolyte/thickener component)
Vb (pH>11, viscosity<5mPa·s)
3.20% CTAB (cationic/thickener component)
0.26% Dodecylbenzene sulphonate (anionic/thickener component)
2.46% Sodium hydroxide (alkali)
4.00% Sodium tripolyphosphate (sequestrant)

Final composition: pH 11.0, viscosity 372 mPa·s

VIa (pH 5.6, viscosity<5mPa·s)
4.22% Hydrogen peroxide (bleach)
0.42% Dequest 2060S (sequestrant)
0.52% Imine quat (bleach activator)
3.66% Primary alkyl sulphate (Empicol LX28* anionic/thickener component)
VIb (pH>11, viscosity<5 mPa·s)
0.56% Dodecyltrimethylammonium bromide (cationic/thickener component
3,06% Sodium chloride (electrolyte/thickener component)
2.28% Sodium hydroxide (alkali)

Final composition: pH 11.0, viscosity 160 mPa·s.

VIIa (pH 5.4, viscosity<5mPa·s)
4.26% Hydrogen peroxide (bleach)
0.42% Dequest 2060S (sequestrant)
0.52% Imine quat (bleach activator)
3.62% Empicol LX28 (anionic/thickener component)
0.64% Tetradecyltrimethylammonium bisulphate (cationic/thickener component
VIIb (pH>11, viscosity<5 mPa·s)
3,26% Sodium chloride (electrolyte/thickener component)

2.32% Sodium hydroxide (alkali)

3.38% Sodium tripolyphosphate (sequestrant)

Final composition: pH 11.0, viscosity 190 mPa·s.

VIIIa (pH 5.5, viscosity<5mPa·s)

4.0% Hydrogen peroxide (bleach)

0.4% Dequest 2060S (sequestrant)

0.5% Imine quat (bleach activator)

1.0% Dodecylbenzene sulphonate (anionic/thickener component)

VIIIb (pH>11, viscosity<5mPa·s)

2.8 Alkyldimethylamine oxide (Empigen OB*) (nonionic/thickener component)

2.4 Sodium hydroxide (alkali)

Final composition: pH 11.2, viscosity 106 mPa·s.

IXa (pH 5.5, viscosity<5mPa·s)

4.0% Hydrogen peroxide (bleach)

0.4% Dequest 2060S (sequestrant)

0.5% Imine quat (bleach activator)

1.0% Primary alkyl sulphate (anionic/thickener component)

IXb (pH>11, viscosity<5mPa·s)

2.8 Empigen OB (nonionic/thickener component)

2.4 Sodium hydroxide (alkali)

3.6 Sodium chloride (electrolyte/thickener component)

Final composition: pH 11.1, viscosity 199 mPa·s.

Xa (pH 5.3, viscosity<5 mPa·s)

4.0% Hydrogen peroxide (bleach)

0.4% Dequest 2060S (sequestrant)

0.5% Imine quat (bleach activator)

1.5% Imbentin 91-35 (nonionic/thickener component)

1.5% Dobanol 1-3 (nonionic/thickener component)

5.9% Primary alkyl sulphate (anionic/thickener component)

Xb (pH>11, viscosity<5 mPa·s)

4.0% Sodium chloride (electrolyte/thickener component)

2.5% Sodium hydroxide (alkali)

Final composition: pH 11.1, viscosity 70 mPa·s.

XIa (pH 5.5, viscosity<5 mPa·s)

4.0% Hydrogen peroxide (bleach)

0.4% Dequest 2060 (sequestrant)

0.5% Imine quat (bleach activator)

2.0% Neodol 91-5*(C10-5EO nonionic/polymer dispersant)

1.6% Acusol 823*(polyacrylate latex thickener)

XIb pH>11, viscosity<5 mPa·s)

3.4% Sodium hydroxide (alkali/thickener component)

Final composition: pH>11, vicosity 55 mPa·s.

EXAMPLES XII–XIV

The following examples, in which the amounts are given as in examples I–XI, were prepared without the addition of imine quat.

XIIa (pH 5.5, viscosity<5mPa·s)

4.0% Hydrogen peroxide (bleach)

0.4% Dequest 2060S (sequestrant)

1.0% Dodecylbenzene sulphonate (anionic/thickener component)

XIIb (pH>11, viscosity<5mPa·s)

2.8 Empigen OB*(nonionic/thickener component)

2.4 Sodium hydroxide (alkali)

Final composition: pH 11.2, viscosity 130 mPa·s.

XIIIa (pH 5.5, viscosity<5mPa·s)

4.0% Hydrogen peroxide (bleach)

0.4% Dequest 2060S (sequestrate)

3.0% Dodecylbenzene sulphonate (anionic/thickener component)

XIIIb (pH>11, viscosity<5mPa·s)

8.4 Empigen OB*(nonionic/thickener component)

2.4 Sodium hydroxide (alkali)

Final composition: pH 11.1, viscosity 500 mPa·s.

XIVa (pH 5.5, viscosity<5mPa·s)

4.0% Hydrogen peroxide (bleach)

0.4% Dequest 2060S (sequestrant)

2.0% Neodol 91-5 (nonionic/polymer dispersant)

2.0% Acusol 823 (polyacrylate latex/thickener component)

XIVb pH>11, viscosity<5mPa·s)

3.45% Sodium hydroxide (alkali/thickener component)

Final composition: pH 11.1, viscosity 110 mPa·s

EXAMPLES XV–XVIII

These examples, in which the amounts are given as in examples I–XI, shows imine quat bleach activator and the peroxygen compound in different partial compositions.

XVa (pH 5.5, viscosity<5 mPa·s)

0.60% Dodecyl-trimethylammonium bromide (cationic/thickener component)

0.26% Imine Quat (bleach activator)

4.50% Sodium chloride (electrolyte/thickener component)

XVb (pH 9.7, viscosity<5 mPa·s)

3.7% Empicol LX 28 (anionic/thickener component)

4.0% Hydrogen peroxide (bleach)

0.4% Dequest 2060S (sequestrant)

Final composition: pH 9.5, viscosity 100 mPa·s.

XVIa (pH 5.5, viscosity<5 mPa·s)

0.6% Dodecyl-trimethylammonium bromide (cationic/thickener component)

2.0% Imine Quat (bleach activator)

5.1% NaC1 (electrolyte/thickener component)

XVIb (pH 9.7, viscosity<5 mPa·s)

3.7% Empicol LX28 (anionic/thickener component)

4.0% Hydrogen peroxide (bleach)

0.4% Dequest 2060S (sequestrant)

Final composition: pH 9.5, viscosity 80 mPa·s.

XVIIa (pH 5.5, viscosity<5 mPa·s)

0.90% Dodecyl-trimethylammonium bromide (cationic/thickener component 0.26% Imine Quat (bleach activator)

4.50% Sodium Chloride (electrolyte/thickener component)

XVIIb (pH 9.7, viscosity<5 mPa·s)

5.1% Empicol LX28 (anionic/thickener component)

4.0% Hydrogen peroxide (bleach)

0.4% Dequest 2060S (sequestrant)

Final composition: pH 9.5, viscosity 145 mPa·s.

XVIIIa (pH 5.5, viscosity<5 mPa·s)

0.90% Dodecyl-trimethylammonium bromide (cationic/thickener component 0.30% Imine Quat (bleach activator)

5.00% NaCl (electrolyte/thickener component)

XVIIIb (pH 9.7, viscosity<5 mPa·s)

5.1% Empicol LX28 (anionic/thickener component)

6.0% Hydrogen peroxide (bleach)

0.4% Dequest 2060S (sequestrant)

Final composition: pH 9.5, viscosity 147 mPa·s.

*The following terms used above are trademarks:

Dequest 2060S Monsanto

Imbentin 91-35 Dr W Kolb AG

Dobanol 1-3 Shell Chemicals

Empigen OB Albright & Wilson

Empicol LX28 Albright & Wilson

Neodol 91-5 Shell Chemicals

Acusol 823 Rohm & Haas

SAS 30 Hoechst

What is claimed is:

1. A multi-part thickenable non-spray dispensible liquid cleaning composition comprising at least two liquid partial compositions each having a viscosity of 20 mPa·s or less and which are held separate from each other in a single container comprising at least two chambers and which at least two liquid partial compositions are delivered using a non-spray dispensing system, wherein at least one partial composition comprises a peroxygen bleach compound and wherein the cleaning composition comprises a multicomponent thickening system of which the components are divided over at least two partial compositions, such that on mixing of the partial compositions the combination of the components of the thickening system causes the final composition to thicken, said final composition having a viscosity of 50 mPa·s or greater.

2. A cleaning composition according to claim 1 characterized in that each partial composition has a pH such that the components of that partial composition are stable on storage, while on admixture of the partial compositions the final composition obtains a pH suitable for cleaning.

3. A cleaning composition according to claim 1 characterised in that the amounts of the partial compositions are equal.

4. A cleaning compositions according to claim 1 comprising two partial compositions.

5. A cleaning composition according to claim 1 wherein the peroxygen bleach compound is chosen fromrthe group consisting of hydrogen peroxide, peracetic acid and alkali metal or alkaline earth metal monoperoxosulphate salts.

6. A cleaning composition according to claim 5 wherein the peroxygen bleach compound is hydrogen peroxide.

7. A cleaning composition according to claim 6 wherein the partial composition containing hydrogen peroxide has pH 10 or below.

8. A cleaning composition according to claim 1 wherein at least one of the partial compositions contains a bleach activator.

9. A cleaning composition according to claim 8 wherein the bleach activator is an imine quat salt.

10. A cleaning compsition according to claim 8 wherein the peroxygen bleach compound and the bleach activator are contained in the same partial composition.

11. A cleaning composition according to claim 1 wherein at least one of the partial compositions contains one or more detergent surfactants.

12. A cleaning composition according to claim 11 wherein the detergent surfactant is a component of the thickening system.

13. A cleaning composition according to claim 11 wherein at least one partial composition contains a cationic surfactant.

14. A cleaning compositions according to claim 1 wherein one of the partial compositions contains sufficient alkali to raise the pH of the final composition to 9 or above after mixing.

15. A container comprising two or more chambers each provided with an outlet opening for dispensing the content of each chamber wherein the chambers hold partial compositions separately which together form a liquid cleaning composition as described in claim 1 and wherein outlet openings together form part of said non-spray dispensing system.

16. A container according to claim 15 wherein the number of chambers each holding a partial composition is two.

17. A container according to claim 15 wherein the chambers have equal volumes.

* * * * *